US006370741B1

(12) United States Patent
Lu

(10) Patent No.: US 6,370,741 B1
(45) Date of Patent: Apr. 16, 2002

(54) STATIONERY CLAMP

(76) Inventor: Haur-Wen Lu, 5F-3, No. 18, Lane 194, Yi-I Rd., Chi-Lung City (TW)

( * ) Notice: Subject to any disclaimer, the term of this patent is extended or adjusted under 35 U.S.C. 154(b) by 0 days.

(21) Appl. No.: 09/736,209

(22) Filed: Dec. 15, 2000

(51) Int. Cl.[7] ..... A44B 21/00; A47B 96/06

(52) U.S. Cl. ..... 24/523; 24/569; 248/316.6; 248/229.12

(58) Field of Search ..... 24/523, 568, 569; 269/101, 160, 164, 189; 248/316.4, 316.6, 229.12, 229.14; 224/277, 279, 484, 485, 486

(56) References Cited

U.S. PATENT DOCUMENTS 4,736,878 A * 4/1988 Rasor ..... 224/321
4,752,991 A * 6/1988 Wegner ..... 24/569 X
5,685,732 A * 11/1997 Lane ..... 24/523 X
5,769,292 A * 6/1998 Cucheran et al. ..... 24/569 X
5,791,609 A * 8/1998 Hankins ..... 248/316.6 X
6,202,266 B1 * 3/2001 Van Den Branden et al. 24/569

* cited by examiner

*Primary Examiner*—Robert J. Sandy
(74) *Attorney, Agent, or Firm*—Bacon & Thomas, PLLC

(57) ABSTRACT

An improved stationery clamp includes a first clamp member, a second clamp member, an adjustable screw bolt and an elastic member to form an adjustable displacement between the first and second clamp member for engaging with a partition of various thickness. The stationery clamp further has a holding slot located on a top side for engaging and supporting various types of stationery set such as paper clip tray, name card rack, mobile phone dock, tape stand or the like. The stationery clamp has great versatility and applicability to mate with different office partitions and hold various types of stationery sets.

10 Claims, 9 Drawing Sheets

STATIONERY CLAMP

BACKGROUND OF THE INVENTION

This invention relates to an improved stationery clamp and particularly a versatile stationery clamp that may be engaged with partition of various thickness for holding a wide variety of stationery sets.

Conventional stationery sets are usually being placed on desk top or being fastened to a wall by nails or screws. Desk top stationery sets tends to make the desk top untidy. Wall fastened stationery sets tend to make wall surface laden with unsightly pits and holes. In order to mitigate aforesaid problems, various stationery fixtures have been developed and introduced. For instance, there are hanger racks which may be nailed or screwed on a wall or partition. The hanger rack has multiple number of hangers for hanging things neatly. However the number of hangers is usually fixed for a given rack and the hangers can only be used for hanging articles. Its applicability and flexibility is severely restricted. Then there are double side tapes which may be stuck to a wall or partition to replace the hanger rack. The tape may stick to the wall or partition without nails or screws, but it leaves sticky residual marks on the wall that are difficult to clear and often become an eyesore. Many contemporary offices use modular office furniture which include partition panels. A pair of adjacent partition panels may join and connect by a bridge strut which has a plurality of slots. Mating stationery racks may be provided to engage with the slots. As office furniture producers have their own specifications and which are usually not compatible with other brands of furniture, the flexibility for mating stationery sets among different brands of furniture and partitions is limited.

SUMMARY OF THE INVENTION

In view of aforesaid disadvantages, it is therefore an object of this invention to provide an improved stationery clamp that may be engaged with a wide variety of partitions or boards used in commonly modular office environments. The clamp further has a holding slot for selectively engaging with a paper clip tray, name card rack, mobile phone dock, tape stand or the like. All of this may greatly enhance the versatility and flexibility of the present invention.

BRIEF DESCRIPTION OF THE DRAWINGS

The invention, as well as its many advantages, may be further understood by the following detailed description and drawings, in which.

DESCRIPTION OF THE PREFERRED EMBODIMENTS

Figure 1:
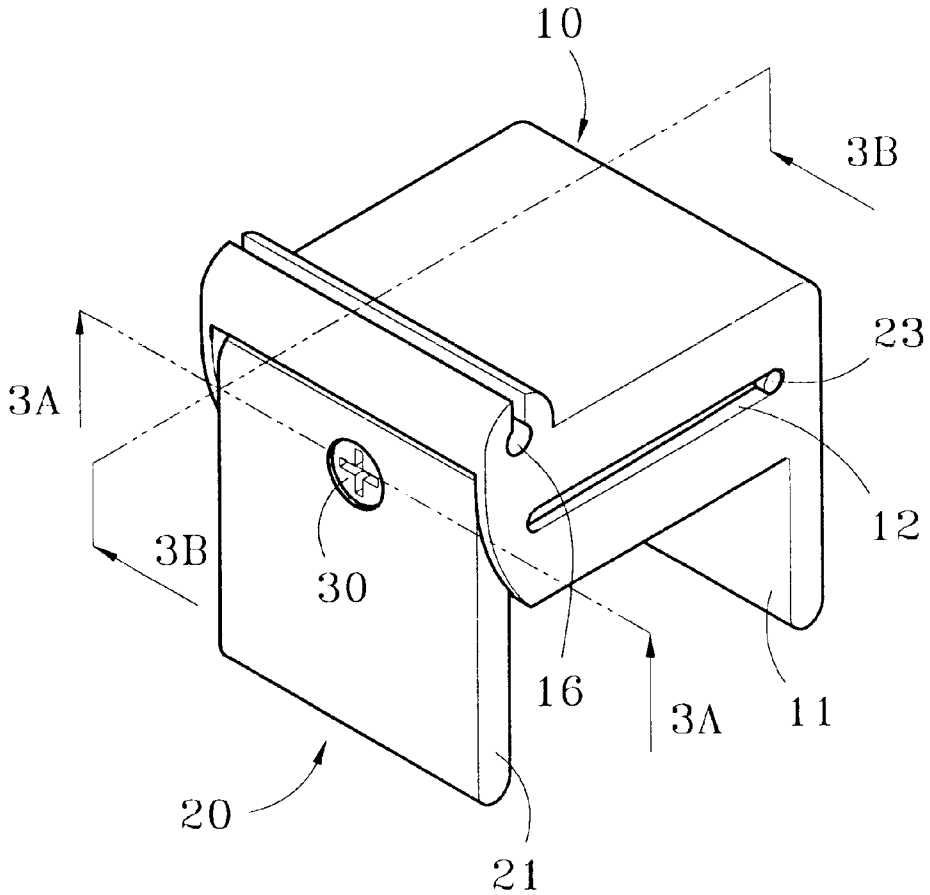
FIG. 1 is a perspective view of this invention.
Figure 2:
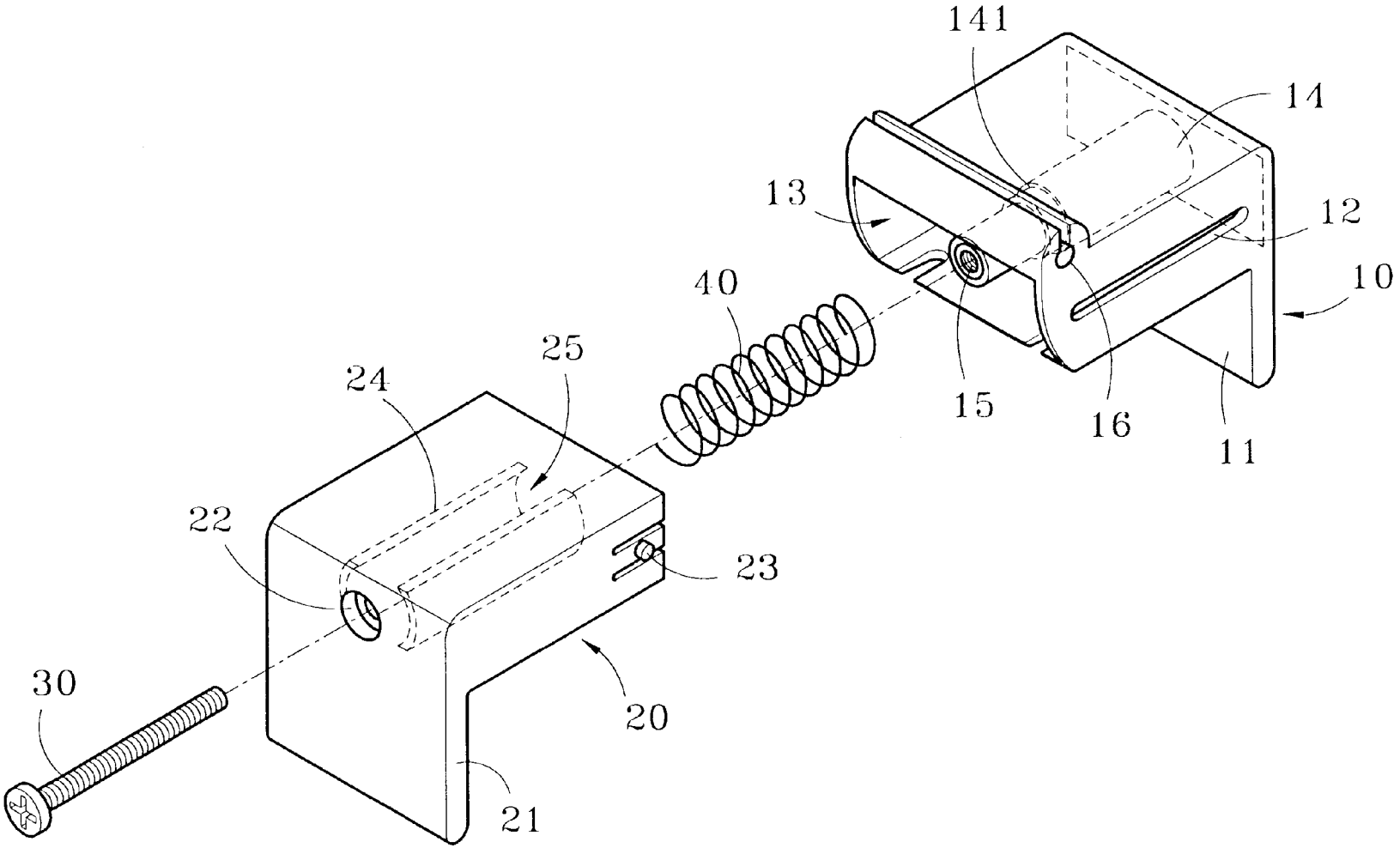
FIG. 2 is an exploded view of this invention.

Referring to FIGS. 1 and 2, the stationery clamp according to this invention has an adjustable width and includes a first clamp member 10, a second clamp member 20, an adjusting screw bolt 30 and an elastic member 40.

The first clamp member 10 includes a first flange 11 located at one end thereof and extended downward, two side walls each has a slide slot 12 of a selected length formed therein, and a first chamber 13 located inside which has a first front opening. Inside the first chamber 13, there is a rod 14 which has a step ring 141 at a selected location thereof to divide the rod 14 in two sections which have different diameters. The front end of the rod 14 has a smaller diameter which has a screw bore 15 formed therein. At the top side of the first clamp member 10, there is a holding slot 16.

The second clamp member 20 may be inserted into the first chamber 13 through the first front opening and includes a second flange 21 located at one end thereof and extended downward, a pair of resilient stubs 23 located at two side walls slidably engageable with the slide slot 12, a guide wall 24 mating with the rod 14, a second chamber 25 formed in the guide wall 24 for holding the elastic member 40 and a through hole 22 formed in a rear wall thereof. The elastic member 40 may be a compression spring which has one end pressing against the step ring 141.

The adjusting screw bolt 30 runs through the through hole 22, elastic member 40 and engages with the screw bore 15.

Through the construction set forth above, the clamping width formed between the first and second flange 11 and 21 may be changed and adjusted to suit different partition or board thickness.

Figure 3A:
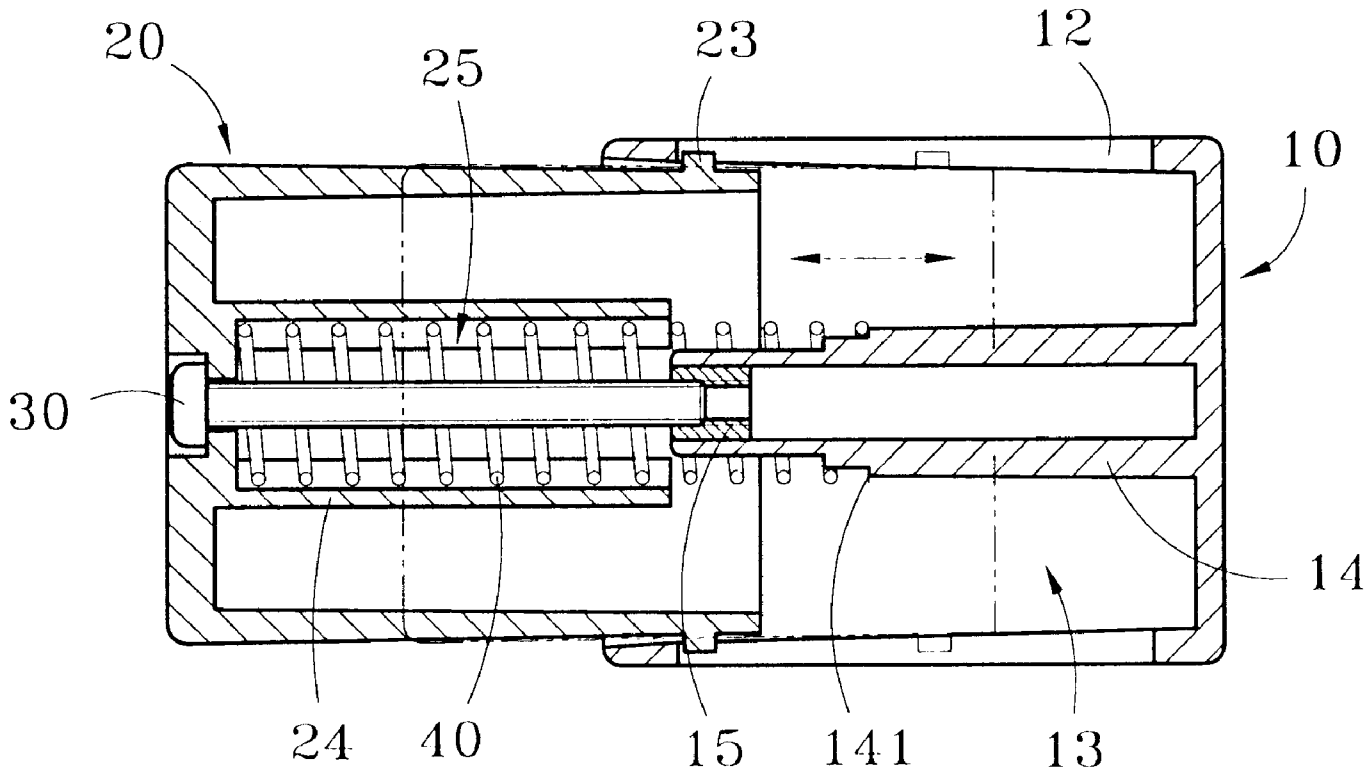
FIG. 3A is a sectional view of this invention, taken on line 3A—3A in FIG. 1.
Figure 3B:
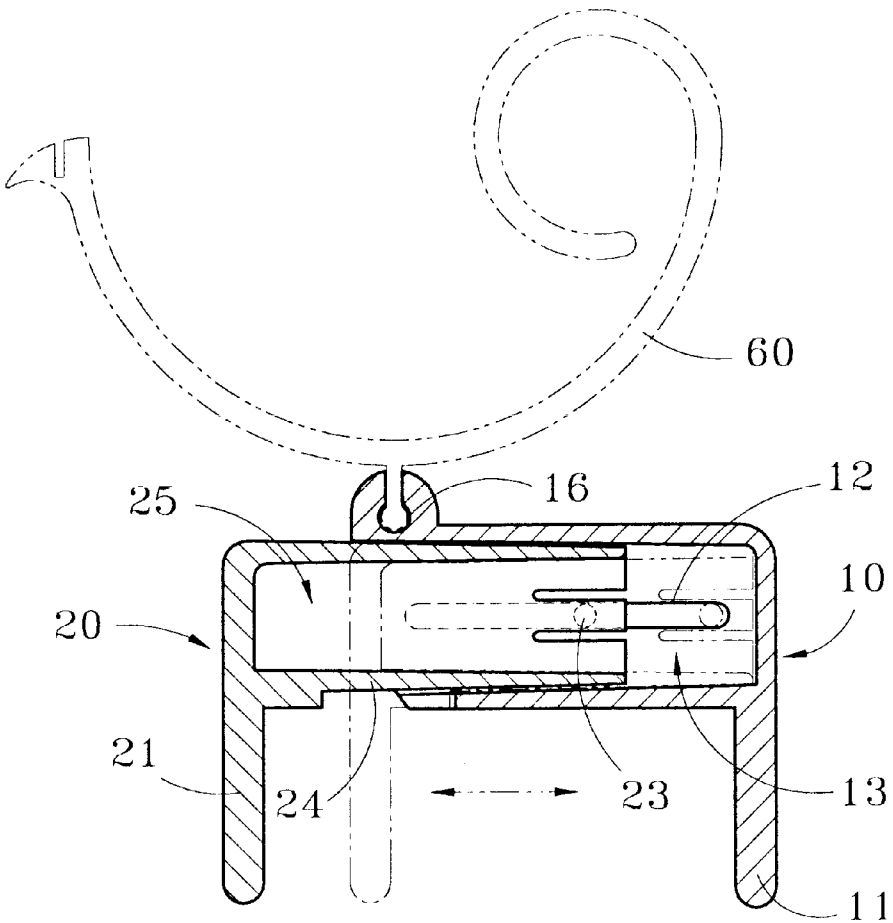
FIG. 3B is a sectional view of this invention, taken on line 3B—3B in FIG. 1.

Referring to FIGS. 3A and 3B, when there is a need to adjust the clamping width, turning the adjusting screw bolt 30 in one or another direction may move the first and second flange 11 and 21 toward or away from each other to change the clamping width formed therebetween. The elastic member 40 helps the first and second clamp member 10 and 20 to move steadily during the width adjustment.

Figure 4:
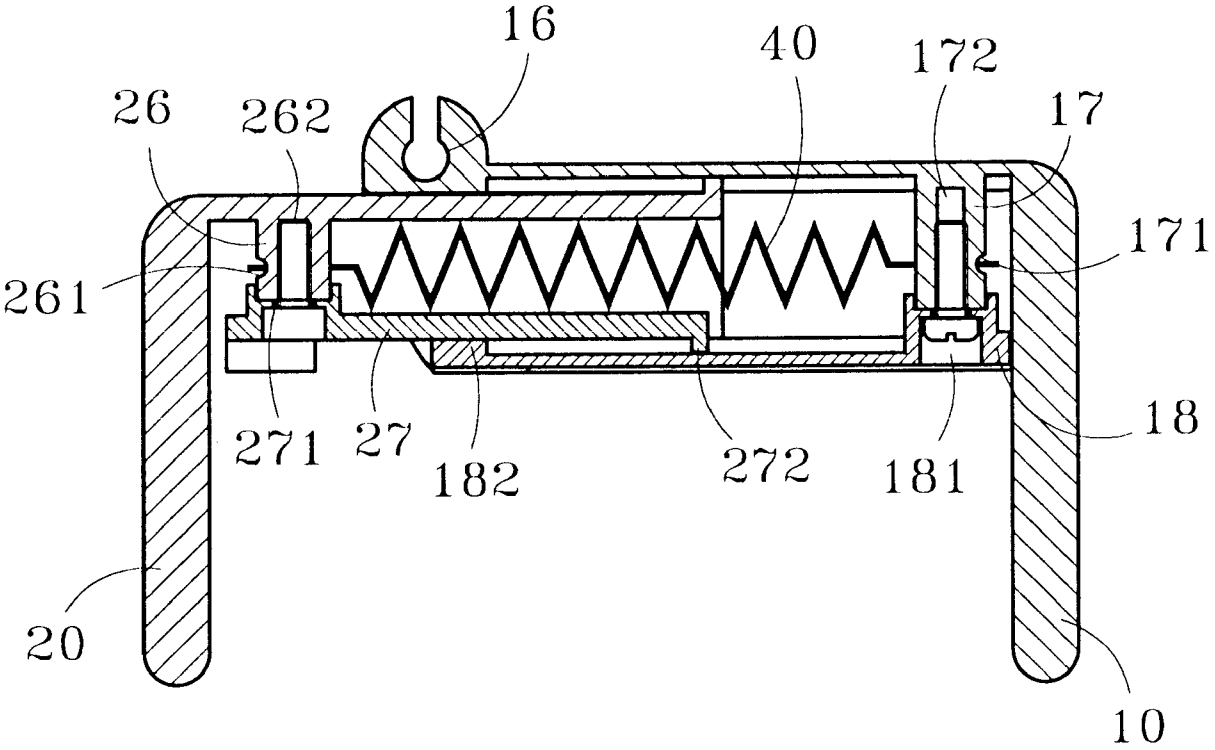
FIG. 4 is a sectional view of another embodiment of this invention.

FIG. 4 illustrates another embodiment of this invention. Below the top walls of the first and second clamp member 10 and 20, there are respectively a first and second strut 17 and 26 each has a first and second notch 171 and 261 formed at a lateral side opposite to each other. The elastic member 40 is an extension type which may be a spring or a rubber band, and has two ends engaged respectively with the first and second notch 171 and 261. The first and second strut 17 and 26 have respectively a bottom end which have a first and second screw hole 172 and 262 formed therein. There is a first bottom lid 18 which has a first aperture 181 to engage with the bottom end of the first strut 17 through screwing the first screw hole 172. There is a second bottom lid 27 which has a second aperture 271 to engage with the bottom end of the second strut 26 through screwing the second screw hole 262. The first and second bottom lid 18 and 27 have respectively a first and second stopper 182 and 272 formed at one end thereof and facing toward each other for defining the adjusting width of the clamp, and preventing the first and second clamp 10 and 20 from disengaging with each other.

Figure 5A:
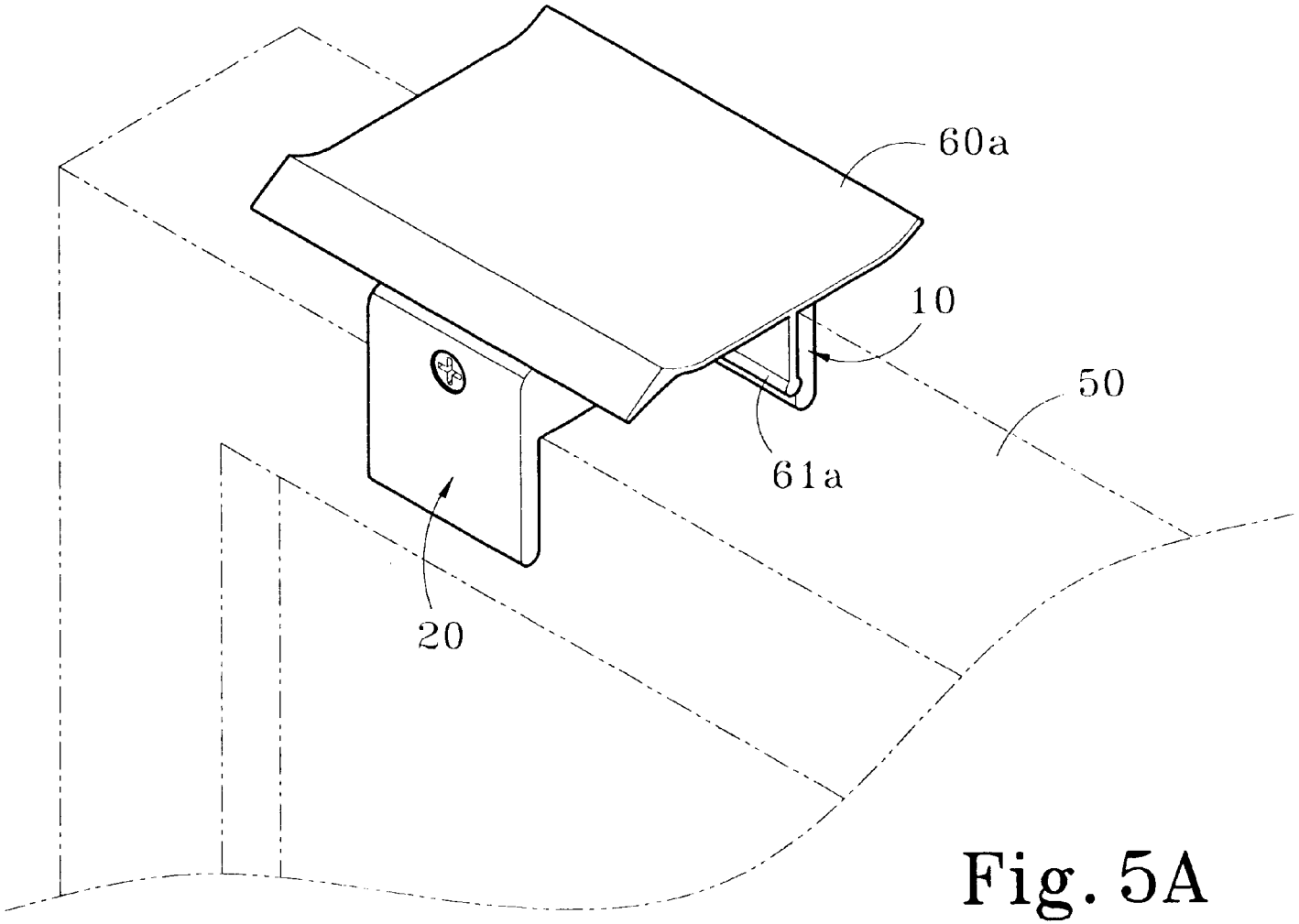
FIG. 5A is a pictorial view of this invention in use.
Figure 5B:
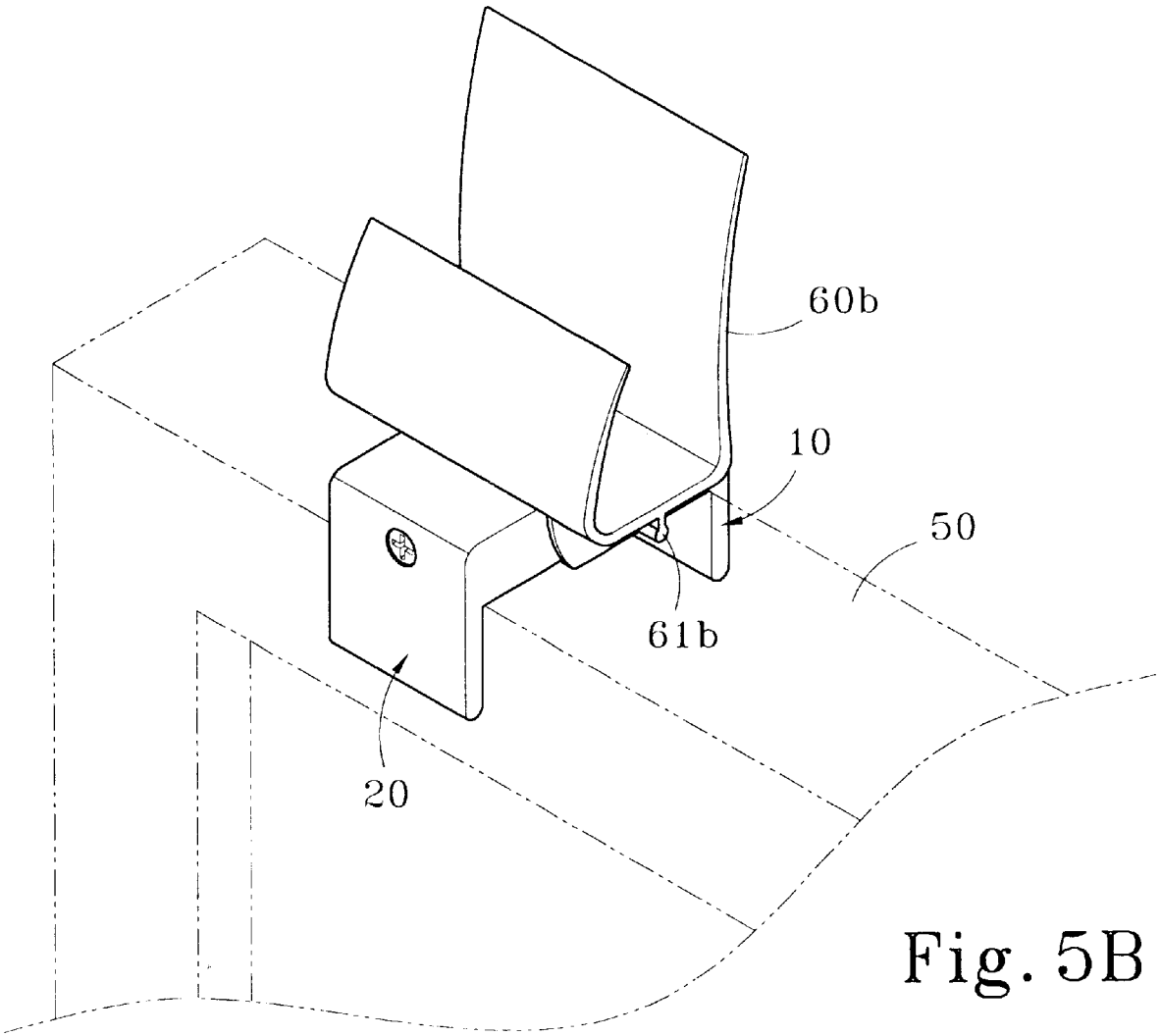
FIG. 5B is another pictorial view of this invention in use.
Figure 5C:
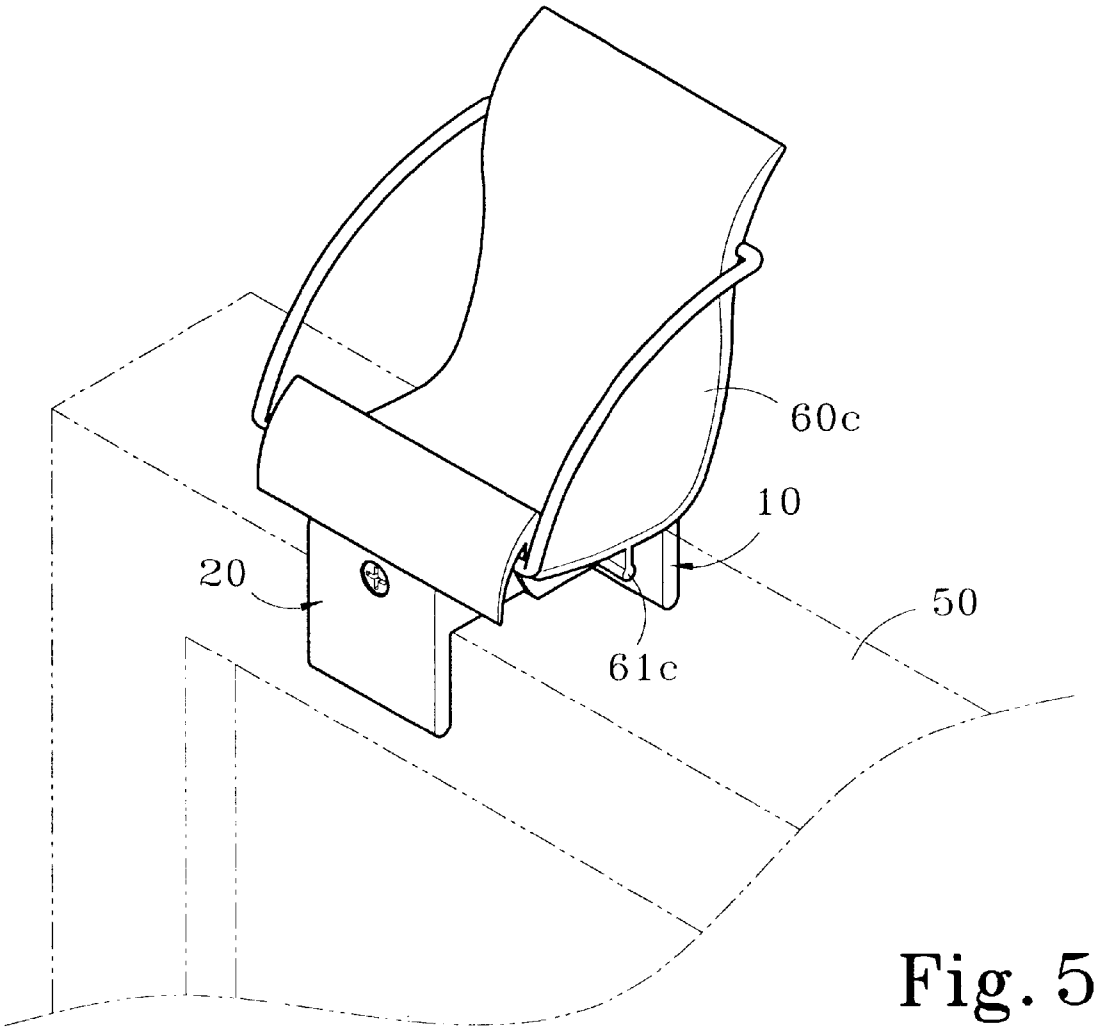
FIG. 5C is further pictorial view of this invention in use.
Figure 5D:
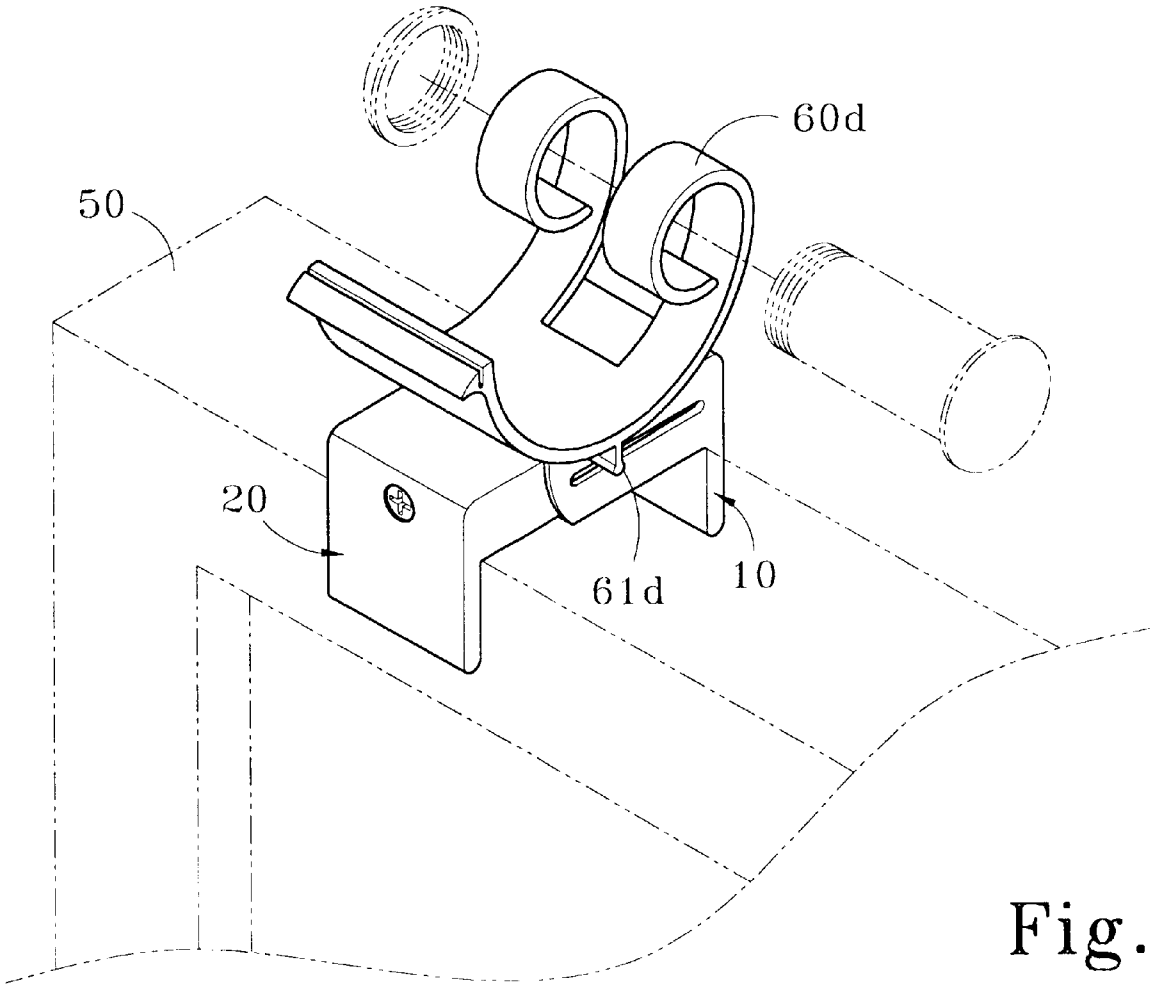
FIG. 5D is yet another pictorial view of this invention in use.

FIGS. 5A through SD show this invention in use to clamp over a partition 50 and support various types of stationery set. FIG. 5A shows that a paper clip tray 60*a* has a first ridge 61*a* located below the bottom thereof for engaging with the holding slot 16 so that the paper clip tray 60*a* may be held securely on the clamp of this invention and mounted on a partition or board. By the same token, FIG. 5B shows that a name card rack 60*b* has a second ridge 61*b* for engaging with the holding slot 16. FIG. 5C shows that a mobile phone dock 60*c* has a third ridge 61*c* for engaging with the holding slot 16. FIG. 5D shows that a tape stand 60*d* has a fourth ridge 61*d* for engaging with the holding slot 16. In addition to support various types of stationery set, this invention may also be adjusted to mount on partitions of different thickness.

It may thus be seen that the objects of the present invention set forth herein, as well as those made apparent from the foregoing description, are efficiently attained. While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An improved stationery clamp having an adjustable displacement to engage with a partition of various thickness, comprising:

a first clamp member including a first flange located at one end thereof and extended downward, a first chamber formed therein which has a front opening, a rod located in the first chamber having a step ring at a selected location dividing the rod in two sections of different diameters, and a holding slot located above the top side thereof, the rod having a front end which has a smaller diameter and a screw bore formed therein;

a second clamp member movable in the first chamber having a second flange located at one end thereof and extended downward, a guide wall located inside thereof forming a second chamber therein mating with the peripheral wall of the rod, an elastic member held in the second chamber having one end pressing against the step ring, and a through hole formed in a rear wall thereof communicating with the second chamber;

an adjustable screw bolt running through the through hole and elastic member for engaging with the screw bore of the rod; and a stationery set having a ridge located below the bottom side thereof engageable with the holding slot of the first clamp member;

wherein the stationery clamp is engageable with the partition of various thickness to support various types of the stationery set.

2. The improved stationery clamp of claim 1, wherein the first clamp member further has two side walls each has a slide slot of a selected length formed therein, the second clamp member has two side walls each has a resilient stub located thereon for slidably engaging with the slide slot for limiting the adjusting displacement and preventing the second clamp member from disengaging from the first clamp member.

3. The improved stationery clamp of claim 1, wherein the elastic member is a compression spring.

4. The improved stationery clamp of claim 1, wherein the stationery set is selectively a paper clip tray, a name card rack, a mobile phone dock or a tape stand.

5. An improved stationery clamp having an adjustable displacement to engage with a partition of various thickness, comprising:

a first clamp member including a first flange located at one end thereof and extended downward, a first strut extended downward from a top wall thereof, a first bottom lid which has a first aperture, and a holding slot located above the top wall thereof, the first strut having a bottom end which has a first screw hole formed therein for engaging with the first bottom lid through the first aperture;

a second clamp member movable in the first clamp member having a second flange located at one end thereof and extended downward, a second strut extended downward from a top wall thereof, and a second bottom lid which has a second aperture, the second strut having a bottom end which has a second screw hole formed therein for engaging with the second bottom lid through the second aperture;

an elastic member having two ends engaging respectively with the first and second strut; and a stationery set having a ridge located below the bottom side thereof engageable with the holding slot of the first clamp member;

wherein the stationery clamp is engageable with the partition of various thickness to support various types of the stationery set.

6. The improved stationery clamp of claim 5, wherein the first and second strut have respectively a notch formed thereon for securely holding the elastic member.

7. The improved stationery clamp of claim 5, wherein the first and second bottom lid have respectively a first and second stopper facing each other for limiting the adjusting displacement and preventing the second clamp member from disengaging from the first clamp member.

8. The improved stationery clamp of claim 5, wherein the elastic member is an extension spring.

9. The improved stationery clamp of claim 5, wherein the elastic member is a rubber band.

10. The improved stationery clamp of claim 5, wherein the stationery set is selectively a paper clip tray, a name card rack, a mobile phone dock or a tape stand.

* * * * *